United States Patent [19]

Boeller

[11] Patent Number: 4,915,234

[45] Date of Patent: Apr. 10, 1990

[54] COSMETIC DEMONSTRATOR

[75] Inventor: Randall L. Boeller, Richardson, Tex.

[73] Assignee: Mary Kay Cosmetics, Inc., Dallas, Tex.

[21] Appl. No.: 322,365

[22] Filed: Mar. 13, 1989

[51] Int. Cl.[4] ..... B65D 69/00

[52] U.S. Cl. ..... 206/581; 206/229; 401/89; 401/98; 132/318; 132/320

[58] Field of Search ..... 206/229, 515, 519, 581; 132/320, 318, 317; 401/52, 53, 98, 89, 88

[56] References Cited

U.S. PATENT DOCUMENTS

| | | | |
|---|---|---|---|
| 282,015 | 12/1985 | Bakic . | |
| 2,042,584 | 6/1936 | Bustamante . | |
| 2,131,077 | 9/1938 | Snyder | 132/320 |
| 2,349,800 | 5/1944 | Lee | 401/98 |
| 2,414,245 | 1/1947 | Rudd | 401/89 |
| 2,454,718 | 11/1948 | Russo . | |
| 2,547,252 | 4/1951 | Bouchard et al. . | |
| 2,604,105 | 7/1952 | Kruck | 132/320 |
| 2,953,142 | 9/1960 | Clementson . | |
| 3,061,084 | 10/1962 | Tibbitts | 401/98 |
| 3,591,298 | 7/1971 | Green . | |
| 4,208,143 | 6/1980 | Nored | 206/229 |
| 4,275,815 | 6/1981 | Davis | 206/519 |
| 4,279,063 | 7/1981 | Joseph | 206/519 |
| 4,471,874 | 9/1984 | Morane . | |
| 4,572,373 | 2/1986 | Johansson | 206/519 |
| 4,711,354 | 12/1987 | Bennett . | |
| 4,739,778 | 4/1988 | Christie | 132/320 |

FOREIGN PATENT DOCUMENTS

| | | | |
|---|---|---|---|
| 254912 | 7/1926 | United Kingdom | 401/98 |

*Primary Examiner*—David T. Fidei
*Attorney, Agent, or Firm*—Michael A. O'Neil

[57] ABSTRACT

A cosmetic demonstrator comprising a substantially conical container having cylindrical sidewalls with first and second ends connected thereto wherein the first end contains a concave depression for storing the cosmetic and the second end contains a central opening extending throughout the container and defined by the cylindrical sidewalls and the first end thereof, for allowing manipulation of the container. Additionally, the containers are stackable, disposable and utilized in a one-time application.

8 Claims, 2 Drawing Sheets

COSMETIC DEMONSTRATOR

TECHNICAL FIELD

This invention relates to a cosmetic demonstrator and in particular to a disposable, stackable lipstick demonstrator that is inexpensive, efficiently manufactured and easily used.

BACKGROUND OF THE INVENTION

History has shown that consumers will not buy cosmetics which are unsatisfactory for the individual's desired use. Indeed, consumers will not purchase a cosmetic without first having had an opportunity to apply the product to their skin. In response to this consumer desire, the cosmetic industry has had a long history of utilizing demonstrators to facilitate this custom. Prior demonstrators have included the manufacture of miniature lipstick dispensers, U.S. Pat. No. 3,591,298, cosmetic kits, U.S. Pat. No. 4,471,874 and cosmetic brushes, U.S. Pat. No. 4,711,354. Prior demonstrators have inherent problems, however, such as easy theft of the demonstrator, storage problems, manufacturing expense and more recently hygienic concerns caused by the re-use of such demonstrators by the consumer in connection with the fear of modern communicable diseases such as AIDS. Additionally, such prior demonstrators do not replicate the same "look and feel" as the normally purchased cosmetic provides the consumer.

Due to these inherent problems, there has been a long-felt need for a cosmetics demonstrator that is inexpensive, easily manufactured, disposable, and more hygienic than those of the prior art.

The applicant's invention provides a cosmetic demonstrator that is easily and inexpensively manufactured, disposable, aesthetically pleasing, hygienic and capable of producing the same "look and feel" as the normally sold cosmetic.

Thus, the present invention provides many advantages and eliminates many of the deficiencies of the prior art.

SUMMARY OF THE INVENTION

The present invention is a cosmetic demonstrator that is disposable, stackable, inexpensive, efficiently manufactured and easily used. In its simplest embodiment, the cosmetic demonstrator comprises a substantially conical container having cylindrical sidewalls and first and second ends connected thereto, means for storing the cosmetic and means for allowing manipulation of the container.

In one embodiment of the invention, the means for storing the cosmetic comprises a concave depression of predetermined size in the first end of the conical container. The means for allowing manipulation of the container comprises a central opening in the second end of the conical container extending throughout the container and defined by the cylindrical sidewalls and first end thereof.

Additionally, in one of the preferred embodiments of the invention, the cylindrical sidewalls have a plurality of inwardly-extending splines of predetermined size and at predetermined locations for lessening the surface-to-surface contact of the conical containers when stacked. This facilitates the removal of the container in order to utilize it in a demonstration of the cosmetic contained therein.

BRIEF DESCRIPTION OF THE DRAWINGS

A more complete understanding of the present invention and the advantages thereof may be had by reference to the following detailed description, taken in conjunction with the accompanying drawings, in which.

DETAILED DESCRIPTION

Figure 1:
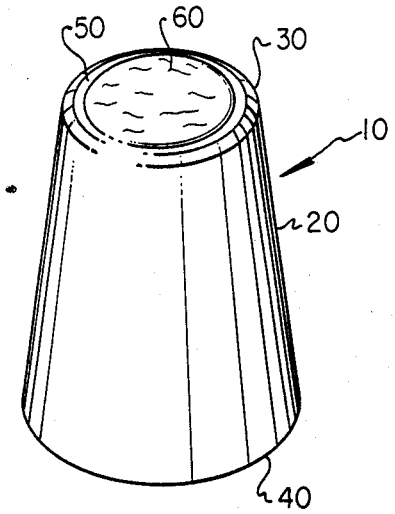
FIG. 1 is a schematic representation of a single container in the preferred embodiment of the present invention.

Referring to FIG. 1, therein is shown a schematic representation of the substantially conical container 10 utilized in the preferred embodiment of the present invention. The substantially conical container 10 has cylindrical sidewalls 20 connected to first and second ends 30 and 40, respectively.

Also illustrated in FIG. 1 is a concave depression 50 in the first end 30. The concave depression 50 is filled with a cosmetic 60. The cosmetic 60 may be of any commercially available cosmetic that is applied to the skin, but in at least one embodiment of the invention is lipstick.

Figure 2:
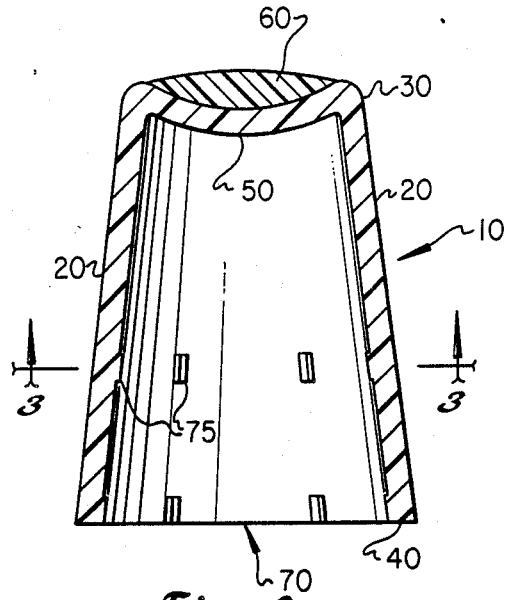
FIG. 2 is a schematic cross-sectional representation of a single container in the preferred embodiment of the present invention.

Turning now to FIG. 2, a cross-sectional representation of the conical container 10, therein is better illustrated the design and function of a single conical container 10 of the cosmetic demonstrator. The conical container 10 including its cylindrical sidewalls 20 and first and second ends 30 and 40, may be formed of any suitable material, including, for example, plastic, wood or metal. In at least one embodiment of the invention, however, the conical container 10 is formed from a plastic-like material, and in particular, from any one of a number of suitable polystyrene $(C_6H_5CHCH_2)_N$ compounds.

Additionally, the conical container 10 may be colored by any of a number of conventional methods well-known in the cosmetic industry to match the shade of cosmetic being demonstrated, or the container may be left in an opaque or transparent condition.

FIG. 2 also discloses that the second end 40 has a central opening 70 that extends throughout conical container 10 and is defined by the cylindrical sidewalls 20 and the first end 30. The central opening 70 allows the consumer or salesperson to insert a finger or a cylindrical shaft into the central opening 70 for manipulation of the conical container 10 to apply the cosmetic 60 located in the concave depression 50 of the first end 30. Such manipulation gives the consumer the same "look and feel" when applying the cosmetic 60 of the conical container 10 during the demonstration as that obtained when applying the normally-purchased commercial product. Tis provides the consumer with a more realistic and aesthetically-pleasing demonstration than heretobefore achieved.

Also disclosed in FIG. 2 are a plurality of inwardly-extending splines 75 along the interior of the cylindrical sidewalls 20 of the conical container 10. These splines are utilized to lessen the surface-to-surface contact of the conical containers 10 when in a stacked configuration as better illustrated in FIGS. 4 and 5. The lessening of the surface-to-surface contact allows a conical container 10 to be more easily removed from the stack when needed for demonstration and application.

Figure 3:
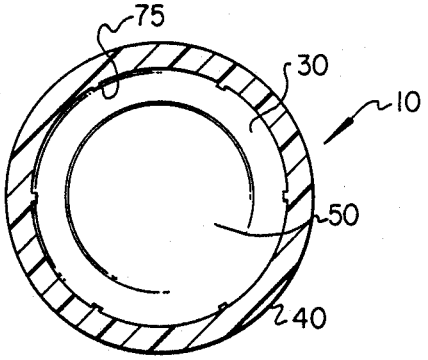
FIG. 3 is a cross-sectional view taken along the lines 3—3 of FIG. 2.

FIG. 3, a cross-sectional representation along the lines 3—3 of FIG. 2, better illustrates the uniformity of the splines 75 along the cylindrical sidewalls 20.

Figure 4:
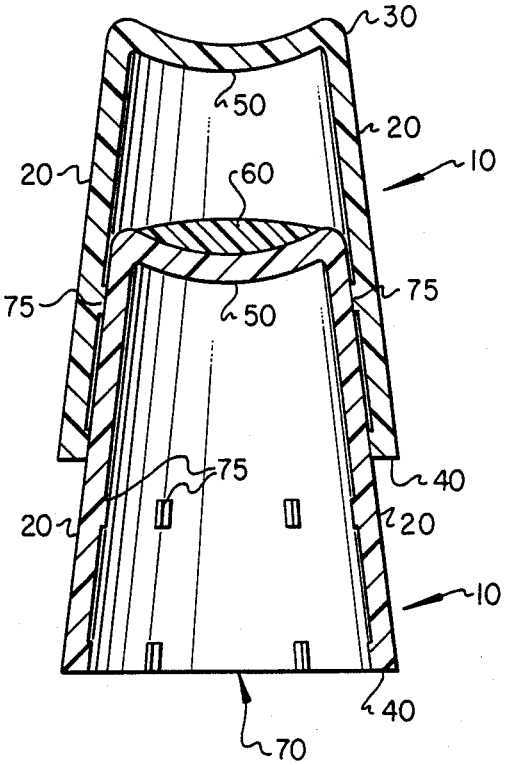
FIG. 4 is a schematic cross-sectional representation of the present invention in a stacked configuration.

Turning now to FIG. 4, therein is shown a cross-sectional representation of a plurality of containers 10 of the same specification as the conical container 10 described in FIGS. 1–3. The concave depression 50 of the first container 10 is devoid of cosmetic 60 and illustrates one embodiment of the invention in which the first conical container 10 of a stack of containers is utilized as a cover for the product contained in the second conical container 10. The individual containers 10 of the cosmetic demonstrator acts as a shield to protect the cosmetic 60 contained in the concave depression 50 of the first end 30 from the outside environment. This helps to protect the integrity of the product as well as promoting the hygienic and aesthetic appearance of the product. This also illustrates the inexpensive nature of Applicant's invention.

FIG. 4 illustrates the splines' 75 ability to lessen the surface-to-surface contact between the plurality of containers 10 when stacked.

Figure 5:
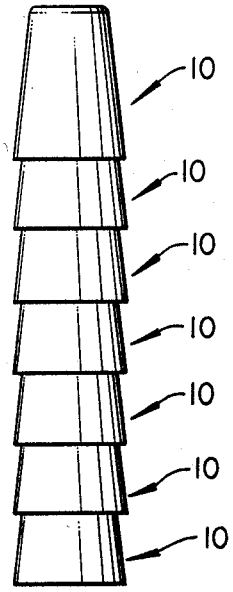
FIG. 5 is a schematic representation of a plurality of containers of the present invention in a stacked configuration.

FIG. 5 best illustrates the stackability of the conical containers 10.

Figure 6:
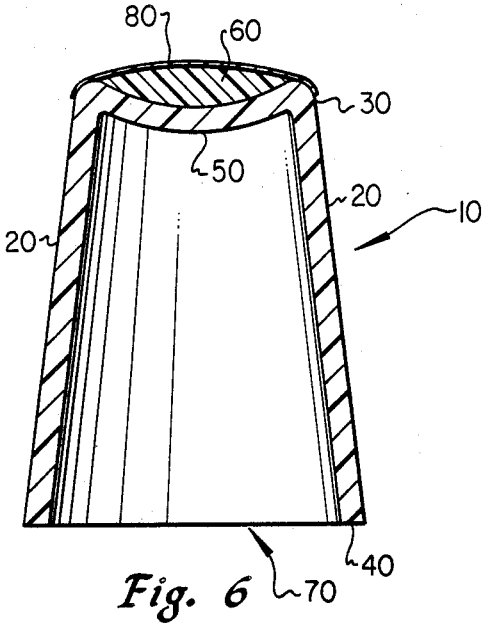
FIG. 6 is a schematic cross-sectional representation of a second embodiment of the present invention.

FIG. 6 discloses a second embodiment of the invention in which the conical container 10 has first and second ends 30 and 40 as well as a concave depression 50 filled with cosmetic 60 identical to the previous embodiment of the invention. There is also a central opening 70 utilized for allowing manipulation and stacking of the conical container 10. This embodiment, however, reveals that the splines 75 are not necessary for stacking the conical containers 10. FIG. 6 also illustrates that the cosmetic 60 and concave depression 50 of the first end 30 may be covered with a thin plastic-like film 80. Such film may be of any known and readily-available plastic-like synthetic polymer material. The embodiment in FIG. 6 also reveals that the cosmetic demonstrator may be packaged by use of the container 10 in an unstacked manner in a larger storage container of an adequate size. In utilizing the embodiment shown in FIG. 6, the conical container 10 would be taken from a storage container, the thin plastic-like film 80 removed and the conical container 10 manipulated as in the preferred embodiment revealed in FIGS. 1–5.

Figure 7:
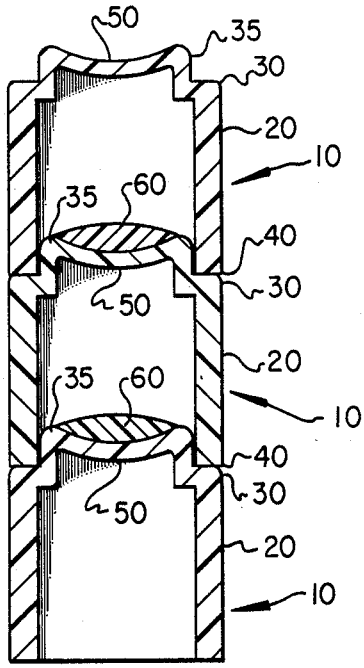
FIG. 7 is a schematic cross-sectional representation of a third embodiment of the present invention in a stacked configuration.

FIG. 7 illustrates a third embodiment of the invention in which the conical container 10 is also stackable. In this embodiment, however, the first end 30 has an extruding circular tip 35 connected thereto which contains the concave depression 50 in which the cosmetic 60 is stored. FIG. 7 also illustrates that the conical container 10 of the present invention may have a cylindrical design rather than the conical design of the previous embodiments. Moreover, the shape of the container 10 is not crucial to the cosmetic demonstrator. Any shape, such as a rectangular, square or circular shape as well as the conical and cylindrical shapes described herein is suitable. In the embodiment of the invention revealed in FIG. 7, the cylindrical sidewalls 20 at the second end 40 are manufactured so as to fit snugly around the circular extruding tip 35 of the first end 30. The embodiment shown in FIG. 7 can also be utilized with or without the thin plastic-like film 80 disclosed in FIG. 6.

Figure 8:
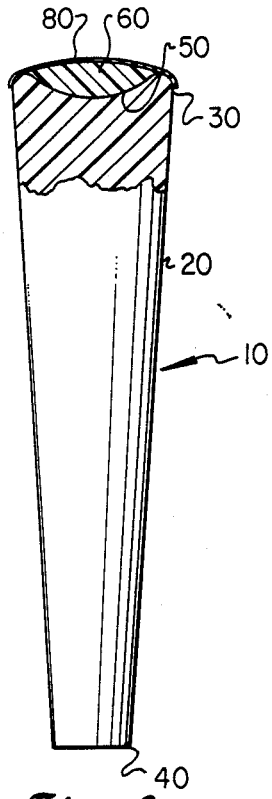
FIG. 8 is a schematic cross-sectional representation of a fourth embodiment of the present invention.

Finally, FIG. 8 reveals yet another embodiment of the present invention in which the conical container 10 has an elongated conical shape having cylindrical sidewalls 20 and first and second ends connected thereto, 30 and 40 respectively. The second end 40 in FIG. 8 does not necessarily have a central opening 70, but the first end 30 continues to have a concave depression 50 for storing the cosmetic 60. In this embodiment the conical container 10 is held at the cylindrical sidewalls 20 by the individual consumer or salesperson in order to apply the cosmetic 60. Additionally, in this embodiment a thin plastic-like film 80 covers the cosmetic 60 in order to prevent contamination and loss of the cosmetic 60. This embodiment, however, allows the same "look and feel" as the other embodiments. Indeed, the pencil-shaped shaft of the cylindrical sidewalls 20 is similar to that of a commercial lipstick holder.

Although the invention has been described in detail, it is to be understood that the same is by way of illustration and in example only and is not to be taken by way of limitation.

I claim:

1. A disposable cosmetic demonstrator comprising a plurality of stackable hollow substantially conical containers having cylindrical sidewalls with a plurality of inwardly-extending splines of predetermined size and at predetermined locations, first and second ends connected to the cylindrical sidewalls, the first end having a concave depression of predetermined size for storing the cosmetic, the second end having a central opening extending throughout the container and defined by the cylindrical sidewalls and first end for allowing manipulation and stacking of the containers.

2. A cosmetic demonstrator in accordance with claim 1 wherein the stored cosmetic is a predetermined amount of cosmetic.

3. A cosmetic demonstrator in accordance with claim 1 wherein the first end is substantially narrower and has a substantially smaller diameter than the second end.

4. A cosmetic demonstrator in accordance with claim 1 wherein the first end and second end have the same diameter.

5. A cosmetic demonstrator in accordance with claim 1 wherein the cosmetic is covered by a relatively thin film of flexible plastic-like material.

6. A disposable cosmetic demonstrator comprising a plurality of stackable hollow substantially cylindrical containers having cylindrical sidewalls of a predetermined size, first and second ends connected to the cylindrical sidewalls, the first end having a substantially circular extruded tip connected thereto and outward-extending edges of predetermined size, the extruded tip having a concave depression of predetermined size for storing the cosmetic, the second end having a central opening extending throughout the container and defined by the cylindrical sidewalls and first end for allowing manipulation of the containers, and the cylindrical sidewalls at the second end capable of stacking upon the outward-extending edges of the first end of a second of the plurality of containers.

7. A cosmetic demonstrator in accordance with claim 6 wherein the stored cosmetic is a predetermined amount of cosmetic.

8. A cosmetic demonstrator in accordance with claim 6 wherein the cosmetic is covered by a relatively thin film of flexible plastic-like material.

* * * * *